US011174585B2

(12) United States Patent
Lee et al.

(10) Patent No.: US 11,174,585 B2
(45) Date of Patent: Nov. 16, 2021

(54) LAUNDRY MACHINE

(71) Applicant: Samsung Electronics Co., Ltd., Suwon-si (KR)

(72) Inventors: Jung Hee Lee, Suwon-si (KR); Jeong Hoon Kang, Seoul (KR); Min Sung Kim, Yongin-si (KR); Ji Hoon Choi, Yongin-si (KR); Kwan Woo Hong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 159 days.

(21) Appl. No.: 15/755,482

(22) PCT Filed: Aug. 12, 2016

(86) PCT No.: PCT/KR2016/008888
§ 371 (c)(1),
(2) Date: Feb. 26, 2018

(87) PCT Pub. No.: WO2017/034196
PCT Pub. Date: Mar. 2, 2017

(65) Prior Publication Data

US 2018/0258577 A1 Sep. 13, 2018

(30) Foreign Application Priority Data

Aug. 26, 2015 (KR) ..... 10-2015-0120334

(51) Int. Cl.
*D06F 39/12* (2006.01)
*D06F 37/04* (2006.01)
(Continued)

(52) U.S. Cl.
CPC ..... *D06F 39/12* (2013.01); *D06F 37/04* (2013.01); *D06F 37/22* (2013.01); *D06F 37/264* (2013.01); *D06F 37/206* (2013.01)

(58) Field of Classification Search
CPC ..... D06F 39/12; D06F 37/02; D06F 37/22; D06F 37/264; D06F 37/206
(Continued)

(56) References Cited

U.S. PATENT DOCUMENTS 3,599,893 A 8/1971 Landolf et al.
4,423,607 A * 1/1984 Munini ..... D06F 37/265 68/23.2
(Continued)

FOREIGN PATENT DOCUMENTS

CN 101802289 A 8/2010
CN 101838900 A 9/2010
(Continued)

OTHER PUBLICATIONS

KR100774166B1—Machine translation (Year: 2007).*
(Continued)

*Primary Examiner* — Tinsae B Ayalew

(57) ABSTRACT

Provided is a washing machine including a rib extending outward from a central portion of a rear portion of a tub. One end of the rib is provided adjacent to the central portion of the tub, the other end of the rib is provided adjacent to an outer side of the tub, and since a width of the one end of the rib is greater than a width of the other end of the rib, thereby maintaining efficient rigidity against stress generated in the rear portion of the tub. Further, in order to secure rigidity against stress due to vibrations generated by a driving motor, an additional rib is included between a side to which the driving motor is coupled and the outer side of the tub, thereby efficiently maintaining rigidity against additional stress.

20 Claims, 16 Drawing Sheets

(51) Int. Cl.
*D06F 37/26* (2006.01)
*D06F 37/22* (2006.01)
*D06F 37/20* (2006.01)

(58) Field of Classification Search
USPC ..... 68/142
See application file for complete search history.

(56) References Cited

U.S. PATENT DOCUMENTS

| | | | | |
|---|---|---|---|---|
| 8,485,002 | B2 | 7/2013 | Quandt et al. | |
| 2007/0062225 | A1 | 3/2007 | Fechtel et al. | |
| 2009/0107187 | A1* | 4/2009 | Kim | D06F 37/269 68/140 |
| 2010/0186462 | A1* | 7/2010 | Quandt | D06F 37/262 68/212 |
| 2015/0252512 | A1 | 9/2015 | Jeon et al. | |

FOREIGN PATENT DOCUMENTS

| | | | |
|---|---|---|---|
| CN | 103229394 | A | 7/2013 |
| CN | 104963953 | A | 10/2015 |
| EP | 2037032 | A1 | 3/2009 |
| JP | 2010012088 | A | 1/2010 |
| KR | 10-2003-0050291 | A | 6/2003 |
| KR | 10-0774166 | B1 | 11/2007 |
| KR | 10-2008-0102780 | A | 11/2008 |
| KR | 10-2011-0025563 | A | 3/2011 |
| KR | 10-2014-0139841 | A | 12/2014 |
| KR | 10-2015-0105092 | A | 9/2015 |
| WO | 2009/040231 | A1 | 4/2009 |

OTHER PUBLICATIONS

KR20110025563A—Machine translation (Year: 2011).*
JP2010012088A—Machine translation (Year: 2010).*
Supplementary European Search Report dated Jun. 26, 2018 in connection with European Patent Application No. 16 83 9485.
ISA/KR, International Search Report and Written Opinion of the International Searching Authority, International Application No. PCT/KR2016/008888, dated Nov. 15, 2016, 11 pages.
European Patent Office, "Communication under Rule 71(3) EPC," Application No. EP16839485.6, dated Jan. 21, 2019, 47 pages.
First Office Action in connection with Chinese Application No. 201680049613.1 dated Nov. 21, 2019, 18 pages.
The Second Office Action in connection with Chinese Application No. 201680049613.1 dated Jul. 14, 2020, 18 pages.
Examination report in connection with Indian Application No. 201817010598 dated Jul. 22, 2020, 7 pages.
China National Intellectual Property Administration of the People"s Republic of China, "The Third Office Action" dated Feb. 20, 2021, in connection with Chinese Patent Application No. 201680049613.1, 13 pages.
The Fourth Office Action dated Jun. 11, 2021, in connection with Chinese Application No. 201680049613.1, 13 pages.

* cited by examiner

LAUNDRY MACHINE

CROSS REFERENCE TO RELATED APPLICATIONS

The present application claims priority under 35 U.S.C. § 365 and is a 371 National Stage of International Application No. PCT/KR2016/008888, filed Aug. 12, 2016, which claims foreign priority to Korean Patent Application No. 10-2015-0120334, filed Aug. 26, 2015, the disclosures of which are fully incorporated herein by reference into the present disclosure as if fully set forth herein.

TECHNICAL FIELD

The present disclosure relates to a washing machine, and more particularly, to a tub configuration of a washing machine.

BACKGROUND

Generally, a washing machine is an apparatus configured to perform washing, rinsing, and drying cycles to wash laundry.

Washing machines are classified into pulsator type washing machines in which a flow of water generated as rotating blades with small blades attached thereto rotate in a lower portion of a washing tub imparts a force on laundry to wash the laundry, agitator type washing machines in which a rotational direction of large stirring blades with blades attached thereto at a center of a washing tub is regularly reversed to generate a flow of water so as to wash laundry, and drum type washing machines in which laundry is put in a drum and washed due to the detergency of a detergent and a force generated by the rising and falling of the laundry as the drum rotates.

A washing machine includes a cabinet, a tub installed inside the cabinet and configured to accommodate washing water, a washing tub rotatably installed inside the tub and configured to accommodate laundry, a driving device configured to rotate the washing tub, a water supply device configured to supply the washing water to the tub, and a discharge device configured to discharge the washing water to the outside of the cabinet from the washing tub when washing is completed.

Meanwhile, while washing is performed, stress is generated in a tub due to vibrations of a driving device such as a motor, and eccentricity in a drum, and particularly, high stress is generated in a rear portion of a tub adjacent to a shaft configured to transfer a driving force of a driving device to the drum.

Accordingly, when rigidity for withstanding the stress occurring toward the rear portion of the tub is not maintained, a loud noise occurs due to the vibrations, and a high capacity washing machine cannot be embodied.

SUMMARY

The present disclosure is directed to providing a washing machine configuration including a tub configuration having improved rigidity.

In addition, the present disclosure is directed to providing a washing machine configuration including a motor coupler configuration having improved rigidity.

One aspect of the present disclosure provides a washing machine including a tub, a drum located inside the tub and installed to be rotatable, and a bearing housing through which a rotational shaft for transferring a rotational force to the drum passes and which is provided in a rear side of the tub, wherein the tub includes a plurality of first ribs provided in the rear portion of the tub and extending outward from a central portion of the tub to support the bearing housing, and a thickness of one end of each of the plurality of first ribs adjacent to the central portion of the tub is greater than a thickness of the other end of each of the plurality of first ribs.

The plurality of first ribs may be provided in a tapered shape.

The plurality of first ribs may be provided in a radial form from the central portion of the tub.

The rear portion of the tub may include a support in an annular shape configured to cover an outer circumferential surface of the bearing housing to support the bearing housing, and the plurality of first ribs may be formed from an outer circumferential surface of the support toward an outer side of the tub.

A portion at which the support is in contact with the first rib may include a rounding portion.

The washing machine may further include a second rib located in the rear portion of the tub and provided in an annular shape.

A thickness of the second rib may be smaller than the thickness of the one end of the first rib.

The second rib may be provided as a plurality of second ribs, and the plurality of second ribs may be disposed to have a distance therebetween which gradually increases from the central portion of the tub to the outer side thereof.

The washing machine may further include a plurality of third ribs provided in a radial form between the plurality of first ribs.

One ends of the plurality of third ribs may extend from the second rib, and the other ends of the plurality of third ribs may be provided on an outer side of the tub.

One end of one first rib among the plurality of first ribs may be in contact with one end of another first rib among the plurality of first ribs adjacent to the one end of the one first rib among the plurality of first ribs, and the other end of the one first rib among the plurality of first ribs may be in contact with the other end of another first rib among the plurality of first ribs adjacent to the other end of the one first rib among the plurality of first ribs.

An auxiliary rib disposed in a diagonal direction with respect to the plurality of first ribs may be provided between the second rib and the one ends of the plurality of first ribs.

The auxiliary rib may be provided as a pair of auxiliary ribs and may be provided in a shape symmetrical to at least one of the plurality of first ribs.

The other ends of the plurality of first ribs may extend to the second rib.

The washing machine may further include an auxiliary rib extending from the other ends of the plurality of first ribs to the outer portion of the tub.

The auxiliary rib may extend in the diagonal direction with respect to the plurality of first ribs and may be provided in a shape symmetrical to at least one of the plurality of first ribs.

The washing machine may include a motor bracket in which a driving motor configured to rotate the drum is installed, a motor coupler provided on one side of the tub to couple the motor bracket to the tub, and a buffer rib disposed between an outer surface of the tub and the motor coupler.

The buffer rib may be spaced apart from the outer surface of the tub and extend in a direction corresponding to an axial direction of the tub.

The buffer rib is provided so as to protrude from the outer surface of the tub toward the outside of the tub.

An auxiliary buffer rib provided in a shape perpendicular to the buffer rib may be provided between buffer ribs.

A washing machine according to an aspect of the present disclosure can include a tub configured with ribs provided in a tapered shape to efficiently withstand stress generated in a housing bearing.

Further, a washing machine can include an additional rib configuration in a motor coupler to efficiently withstand stress generated in a motor.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
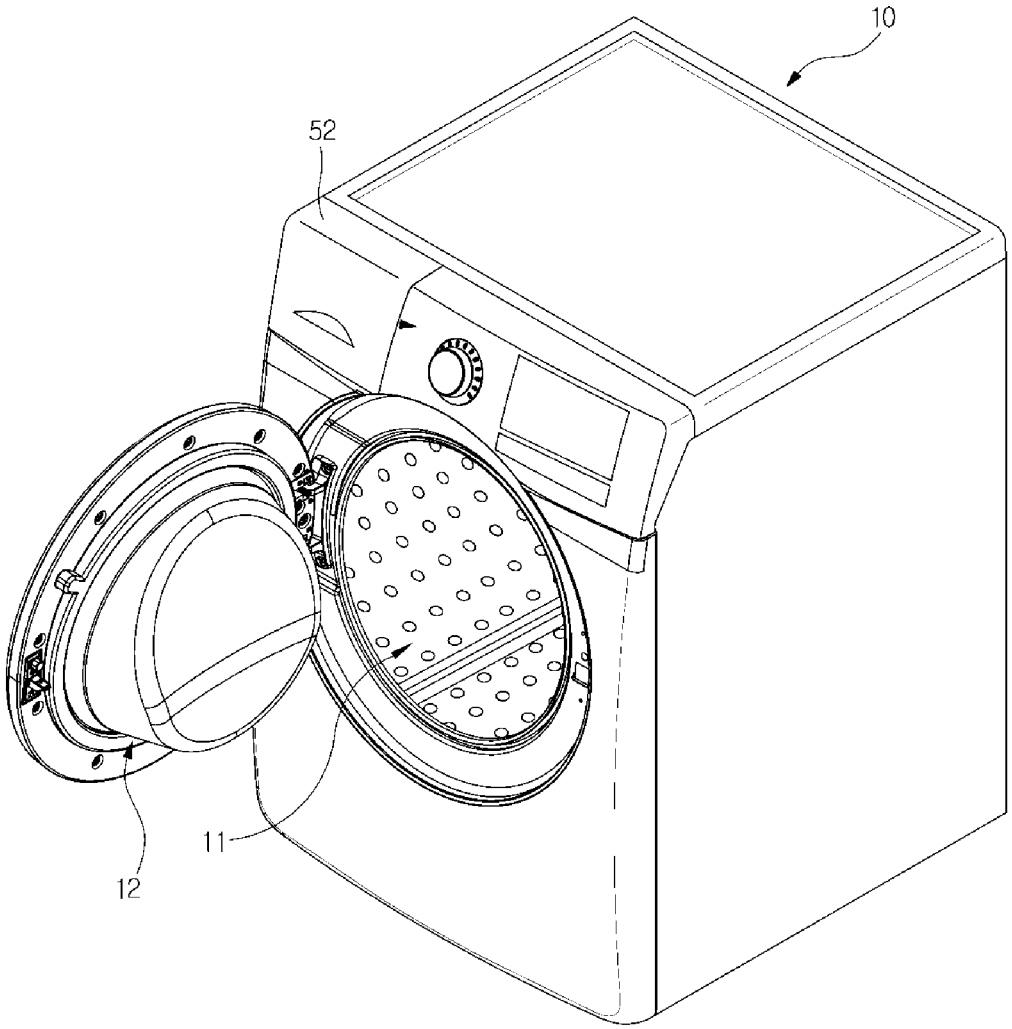
FIG. 1 is a perspective view of a washing machine according to one embodiment of the present disclosure.

FIGS. 1 through 16, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments described in the specification and configurations shown in the accompanying drawings are merely exemplary examples of the present disclosure, and various modifications may replace the embodiments and the drawings of the present disclosure at the time of filing of the present application.

Further, identical symbols or numbers in the drawings of the present disclosure denote components or elements configured to perform substantially identical functions.

Further, terms used herein are only for the purpose of describing particular embodiments and are not intended to limit the present disclosure. The singular form is intended to include the plural form as well, unless the context clearly indicates otherwise. It should be further understood that the terms "include," "including," "have," and/or "having" specify the presence of stated features, integers, steps, operations, elements, components, and/or groups thereof, but do not preclude the presence or addition of one or more other features, integers, steps, operations, elements, components, and/or groups thereof.

Further, it should be understood that, although the terms "first," "second," etc. may be used herein to describe various elements, the elements are not limited by the terms, and the terms are only used to distinguish one element from another. For example, a first element could be termed a second element, and similarly, a second element could be termed a first element without departing from the scope of the present disclosure. The term "and/or" includes combinations of one or all of a plurality of associated listed items.

Further, the terms "frontward direction, front surface," "rearward direction, rear surface" "upper side," "lower side," used herein are defined on the basis of a front portion of a washing machine according to one embodiment of the present disclosure shown in FIG. 1, that is, on the basis of a front surface in FIG. 1.

In addition, the terms "rotational axis," "radial direction" used herein are based on a rotational axis of a drum provided in a front-rear direction of the washing machine according to one embodiment of the present disclosure shown in FIG. 1, and directions crossing the rotational axis in lateral and vertical directions on the basis of the rotational axis are defined as a radial direction.

Hereinafter, embodiments according to the present disclosure will be described in detail with reference to the accompanying drawings.

Figure 2:
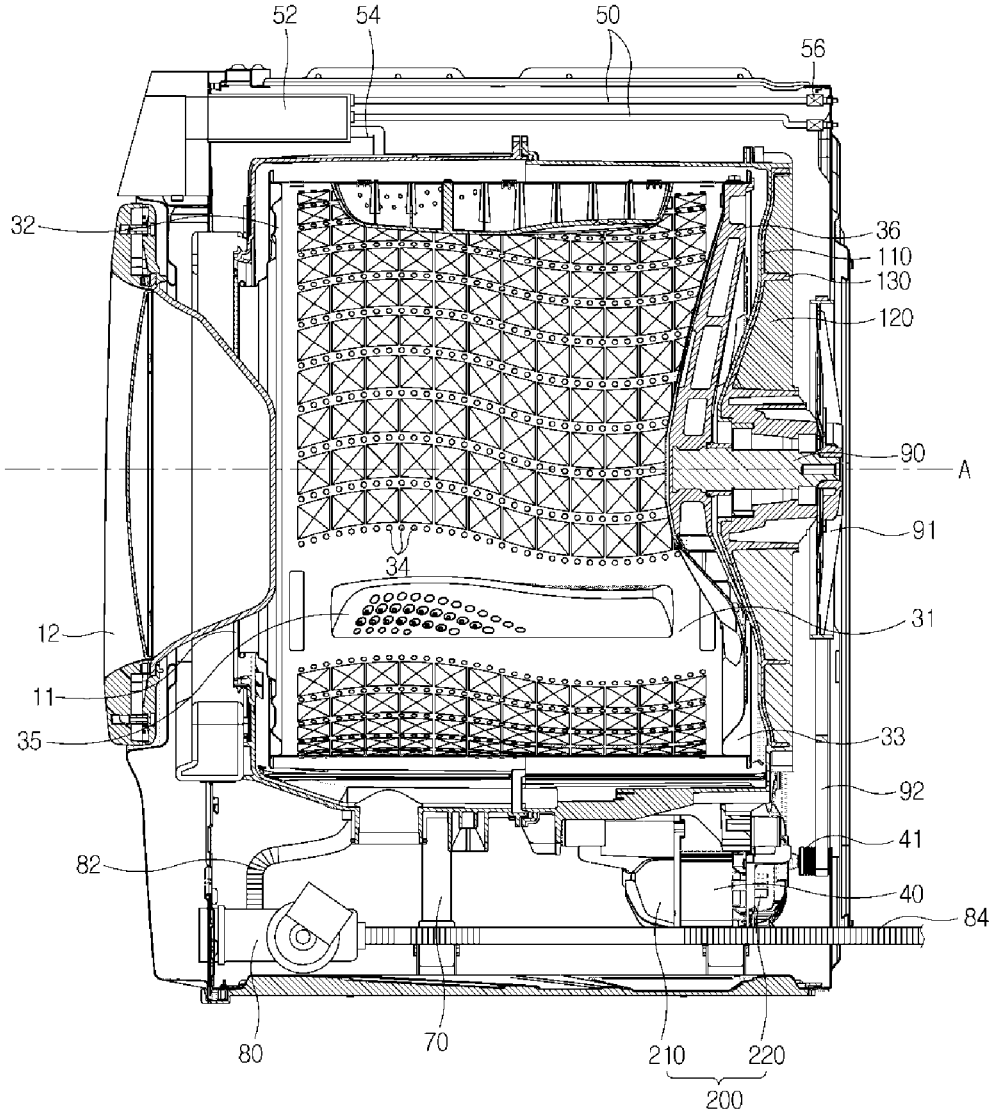
FIG. 2 is a side sectional view of the washing machine according to one embodiment of the present disclosure.
Figure 3:
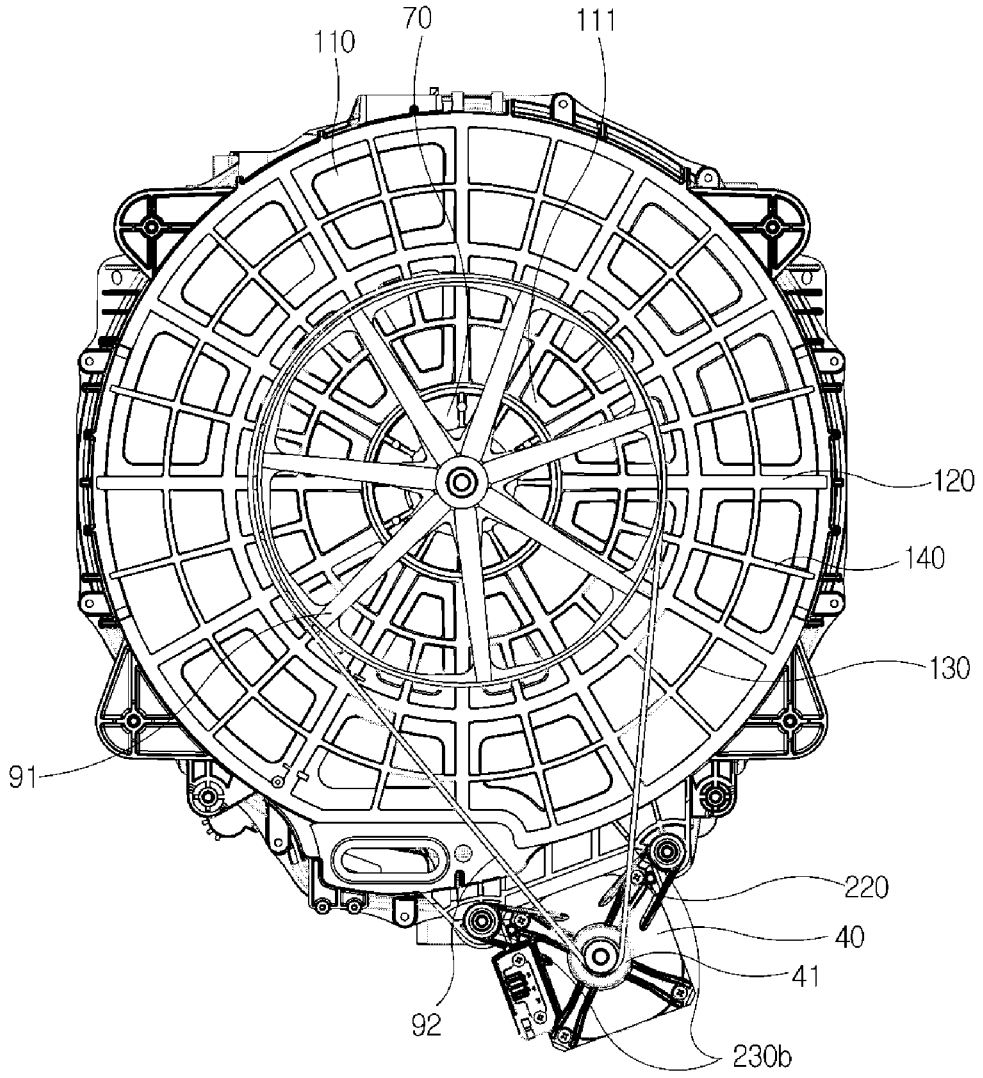
FIG. 3 is a rear view of a partial configuration of the washing machine according to one embodiment of the present disclosure.
Figure 4:
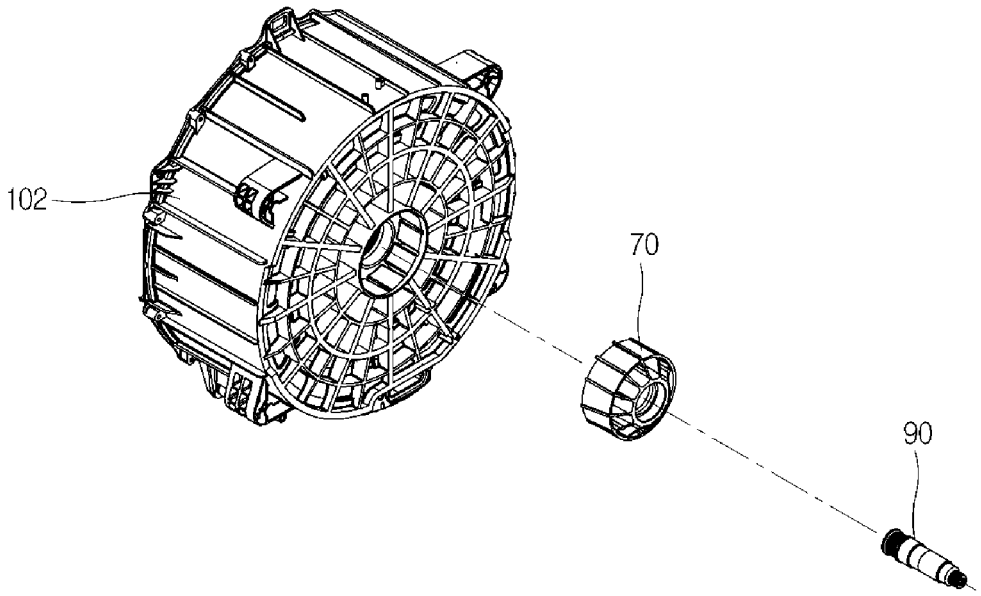
FIG. 4 is an exploded perspective view of the partial configuration of the washing machine according to one embodiment of the present disclosure.
Figure 5:
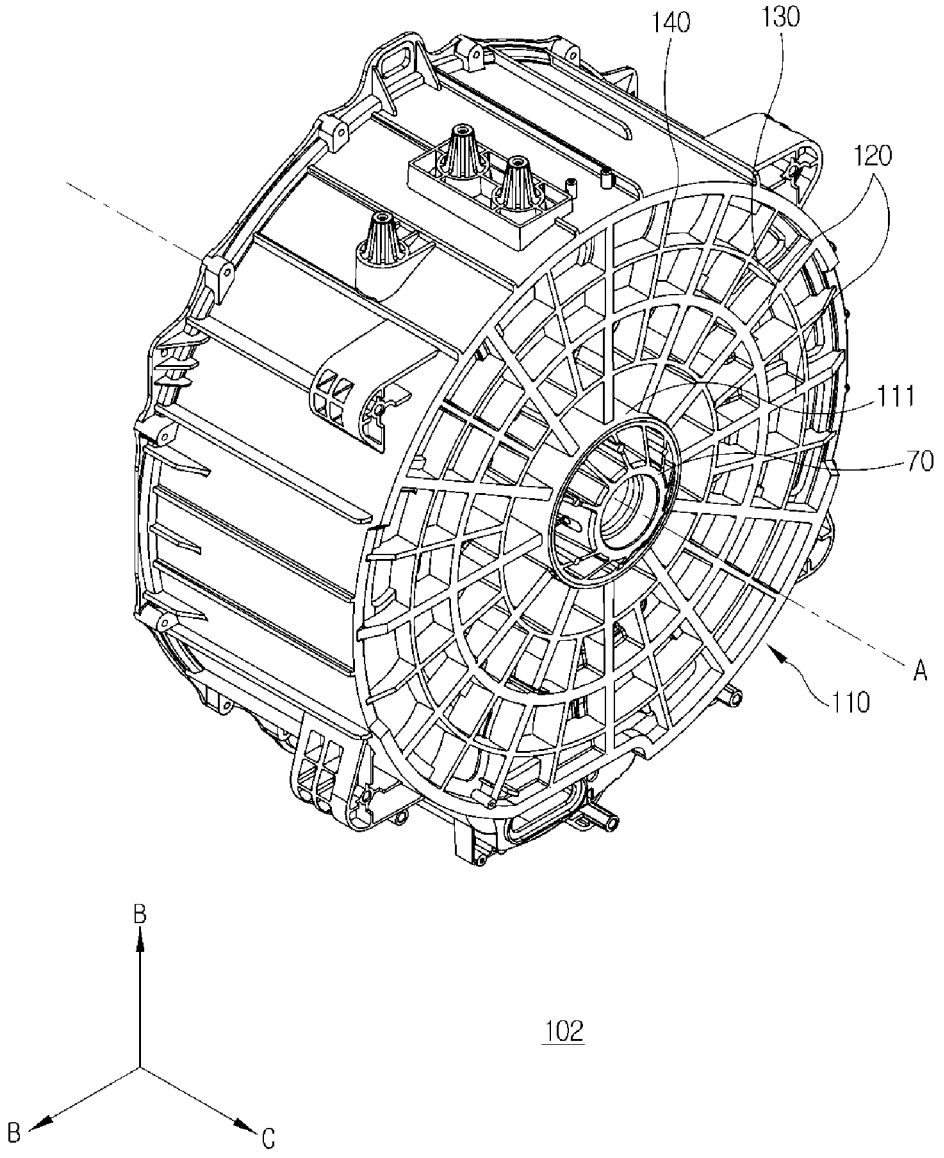
FIG. 5 is a perspective view of a rear tub of the washing machine according to one embodiment of the present disclosure.

FIG. 1 is a perspective view of a washing machine according to one embodiment of the present disclosure, FIG. 2 is a side sectional view of the washing machine according to one embodiment of the present disclosure, FIG. 3 is a rear view of a partial configuration of the washing machine according to one embodiment of the present disclosure, FIG. 4 is an exploded perspective view of the partial configuration of the washing machine according to one embodiment of the present disclosure, and FIG. 5 is a perspective view of a rear tub of the washing machine according to one embodiment of the present disclosure.

As shown in FIGS. 1 to 5, a washing machine 1 includes a main body 10 forming an exterior thereof, a tub 100 disposed inside the main body 10, a drum 30 rotatably disposed inside the tub 100, and a driving motor 40 configured to drive the drum 30.

An inlet 11 is formed in a front surface of the main body 10 so that laundry may be put inside the drum 30. The inlet 11 is opened or closed by a door 12 installed at the front of the main body 10.

Water supply pipes 50 configured to supply washing water to the tub 100 are installed above the tub 100. One sides of the water supply pipes 50 are connected to water supply valves 56, and the other sides of the water supply pipes 50 are connected to a detergent container 52.

The detergent container 52 is connected to the tub 100 through a connection pipe 54. Water supplied from the water supply pipes 50 is supplied into the tub 100 with detergent via the detergent container 52.

The tub 100 is supported by a damper 60. The damper 60 connects a lower inner surface of the main body 10 and an outer surface of the tub 100.

The drum 30 includes a cylindrical portion 31, a front plate 32 disposed at the front of the cylindrical portion 31, and a rear plate 33 disposed at the rear of the cylindrical portion 31, and may be rotatable around a rotational axis A extending in a front-rear direction of the washing machine 1. An opening 32*a* for putting in and taking out laundry is formed in the front plate 32 provided at a front side of the rotational axis A, and a driving shaft 90 configured to transmit power of the driving motor 40 is connected to the rear plate 33 provided at a rear side of the rotational axis A. A flange shaft 36 configured to support the driving shaft 90 may be mounted on the rear plate 33.

A plurality of through holes 34 for circulation of washing water are formed in a circumferential surface of the drum 30, and a plurality of lifters 35 installed to allow laundry to rise and fall when the drum 30 is rotated are installed on an inner circumferential surface of the drum 30.

The drum 30 and the driving motor 40 are connected by the driving shaft 90, and, according to a connection form of the driving shaft 90 and the driving motor 40, the washing machine 1 may be classified into a direct driving type washing machine in which the driving shaft 90 is directly connected to the driving motor 40 so that the drum 30 is rotated, and an indirect driving type washing machine in which a pulley connects the driving motor 40 and the driving shaft 90 to rotate the drum 30.

The washing machine 1 according to one embodiment of the present disclosure may be provided as the indirect driving type washing machine, but is not limited thereto, and technical features of the present disclosure may also be applied to the direct driving type washing machine.

One end of the driving shaft 90 is connected to the rear plate 33 of the drum 30, and the other end of the driving shaft 90 extends outward from a rear portion 110 provided at a rear portion of the tub 100 with respect to the rotational axis A. A driving pulley 91 may be provided on the other end of the driving shaft 90 to receive a driving force from the driving motor 40.

That is, since the drum 30 is rotated around the driving shaft 90 by rotation of the driving shaft 90, the rotational axis A of the drum 30 may be provided on a line corresponding to the driving shaft 90.

Further, a motor pulley 41 is provided on a rotational shaft of the driving motor 40. The driving belt 92 is provided between the motor pulley 41 and the driving pulley 91, and the driving shaft 90 may be driven by the driving belt 92.

The driving motor 40 is disposed on one lower side of an outer circumferential surface of the tub 100 so that driving shaft 90 may be driven while the driving belt 92 is rotated clockwise or counterclockwise in a vertical direction of the tub 100. Coupling the driving motor 40 and the tub 100 will be described in detail below.

A bearing housing 70 is installed in the rear portion 110 of tub 100 to rotatably support the driving shaft 90. The bearing housing 70 may be formed of an aluminum alloy, and when the tub 100 is injection-molded, the bearing housing 70 may be inserted into the rear portion 110 of the tub 100.

A drain pump 80 configured to discharge water in the tub 100 to the outside of the main body 10, a connection hose 82 configured to connect the tub 100 and the drain pump 80 to allow the water in the tub 100 to be introduced into the drain pump 80, and a drain hose 84 configured to guide water pumped by the drain pump 80 to the outside of the main body 10 are provided under the tub 100.

Meanwhile, a control panel and a printed circuit board assembly (not shown) are provided on a front surface of the main body 10 so that a user may control the operation of the washing machine 1.

The rear portion 110 of the tub 100 will be described in detail below.

Figure 6:
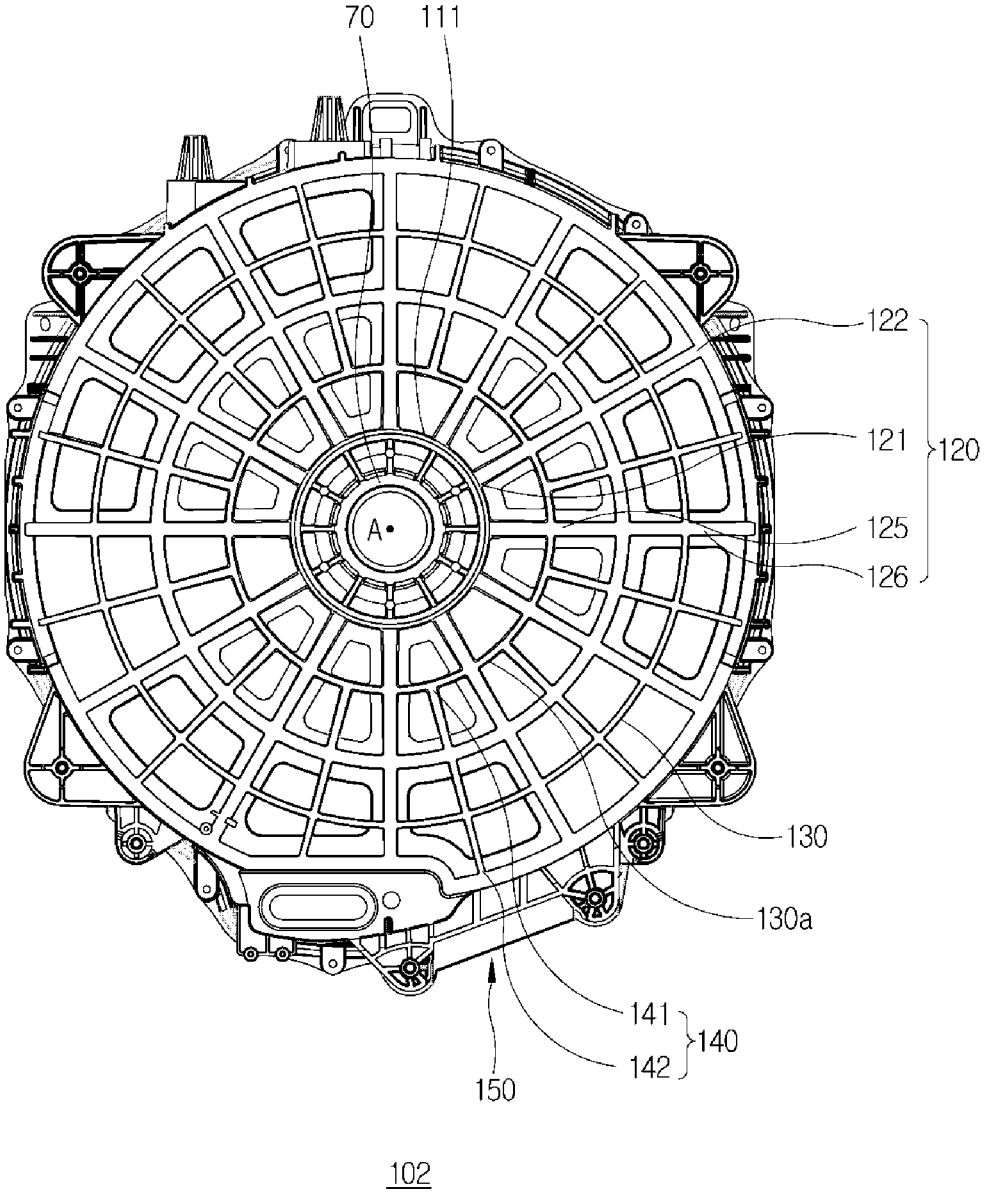
FIG. 6 is a rear view of the rear tub of the washing machine according to one embodiment of the present disclosure.
Figure 7:
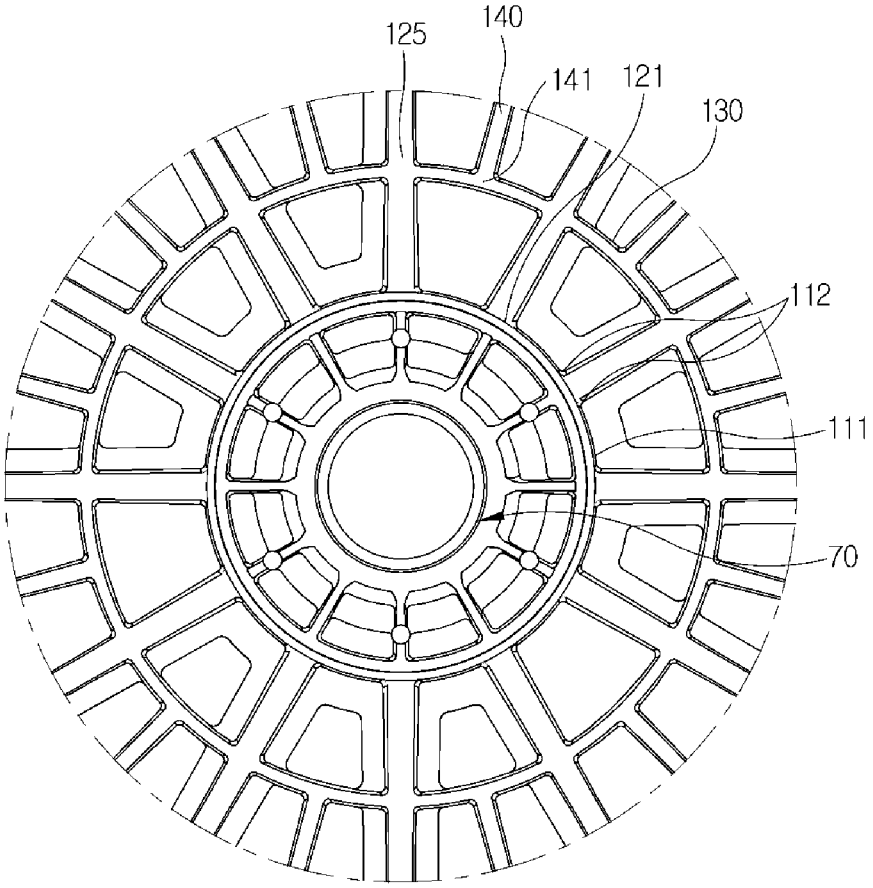
FIG. 7 is an enlarged view of a rear surface of the rear tub of the washing machine according to one embodiment of the present disclosure.
Figure 8:
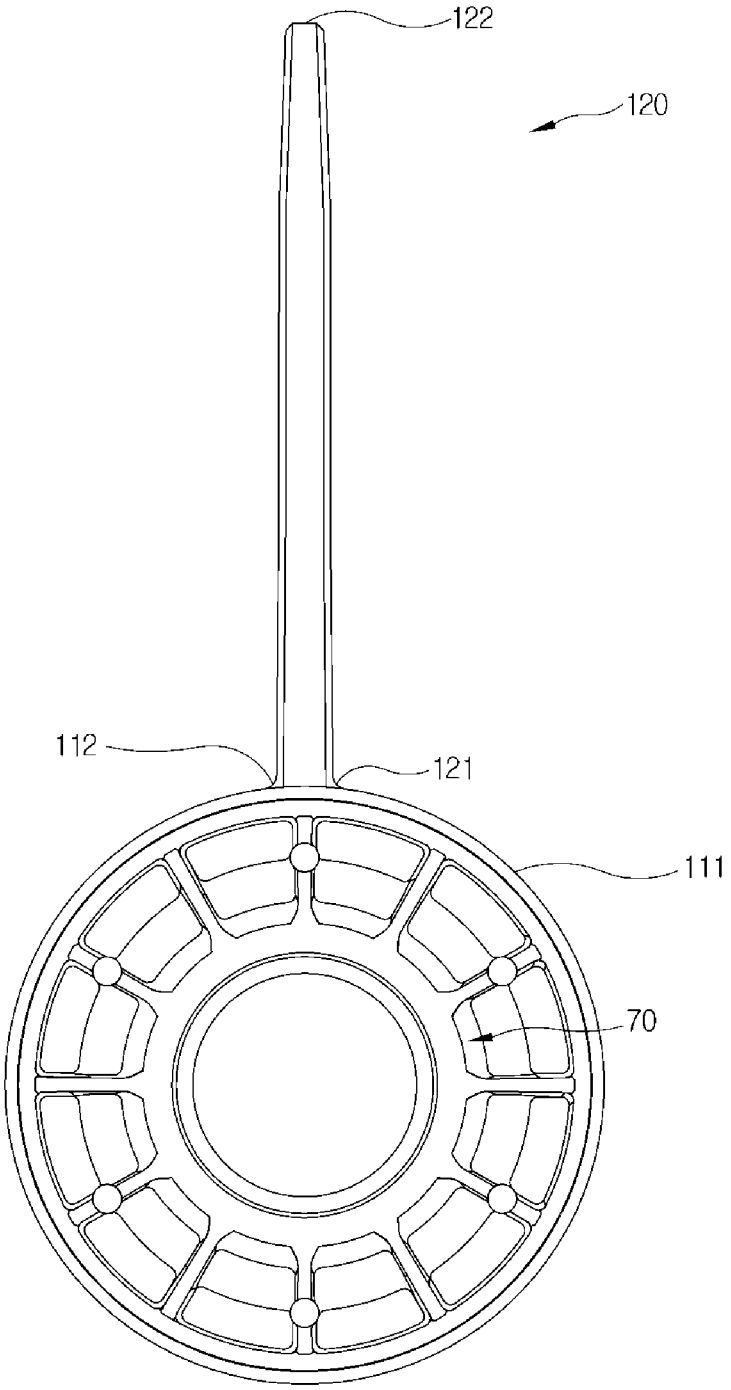
FIG. 8 is a view illustrating a support and a first rib of the washing machine according to one embodiment of the present disclosure.

FIG. 6 is a rear view of the rear tub of the washing machine according to one embodiment of the present disclosure, FIG. 7 is an enlarged view of a rear surface of the rear tub of the washing machine according to one embodiment of the present disclosure, and FIG. 8 is a view illustrating a support and a first rib of the washing machine according to one embodiment of the present disclosure.

The tub 100 may be provided to cover the drum 30 which rotates and is provided in a cylindrical shape of which a front surface is open with respect to the rotational axis A. In some cases, the tub 100 may be separated into a front tub 101 and a rear tub 102 which are provided to be assembled.

One end of the front tub 101 is provided in contact with one end of the rear tub 102, and the front tub 101 and the rear tub 102 may be assembled by a flange-shaped assembler provided at each one end.

A rear surface of the rear tub 102 may be provided with the rear portion 110 into which a bearing housing 70 is inserted. The bearing housing 70 is seated on a central portion of the rear portion 110, so that the driving shaft 90 passes through the tub 100 and may be linked with the drum 30.

That is, on the basis of the rotational axis A of the drum 30, an opening is formed in one end in the front of the tub 100, and the rear portion 110 provided with the driving shaft 90 configured to drive the drum 30, the bearing housing 70 through which the driving shaft 90 passes, and ribs 120,130, and 140, which will be described below, may be provided at the other end of the tub 100.

As described above, the bearing housing 70 may be inserted into and injection-molded with the rear tub 102 during injection molding of the rear tub 102. However, the present embodiment of the present disclosure is not limited thereto, and the bearing housing 70 may be assembled to be seated into the rear portion 110 during a subsequent process after the rear tub 102 is injection-molded.

The driving shaft 90 is connected to a rear portion of the drum 30 and serves to simultaneously rotate and support the drum 30. In this case, since the driving shaft 90 supports only one side of the drum 30, stress may be naturally generated in a vertical direction of the driving shaft 90 or the rotational axis A due to the load of the drum 30, and when the drum 30 is rotated, stress may be generated in a circumferential direction of the driving shaft 90 or a direction in which the drum 30 is rotated around the rotational axis A.

The stress generated from the driving shaft 90 may be transferred to the bearing housing 70 for supporting the driving shaft 90 and the rear portion 110 of the tub 100 for supporting the bearing housing 70.

Accordingly, in a case in which rigidity against the stress transferred to the rear portion 110 is not considered in a design of the rear portion 110, the tub 100 may be damaged, or severe vibrations may occur when the drum 30 is driven, and thus, operational reliability of the washing machine 1 may be degraded and a loud noise may occur when the washing machine 1 is operated.

Accordingly, the rear portion 110 may include first ribs 120 extending from the rotational axis A in a radial direction B of the tub 100 to improve the rigidity of the rear portion 110. In detail, the first rib 120 may be provided to extend from a support 111 for supporting the bearing housing 70 in the radial direction B of the tub 100 perpendicular to the rotational axis A to a portion adjacent to an outer circumferential surface of the rear portion 110.

A plurality of first ribs 120 may be provided and disposed in a radial form. Accordingly, the first ribs 120 may be disposed to be spaced apart from each other on an outer circumferential surface of the support 111, and may extend in the radial direction B of the tub 100.

The support 111 may be formed in an annular cylindrical shape extending in a rotational axis A direction to cover an outer circumferential surface of the bearing housing 70. In detail, the support 111 may be provided to protrude in an outward direction of the rear portion 110, that is, in a rearward direction C of the rotational axis A. The support 111 may be integrally molded with the rear portion 110 during injection molding.

One ends 121 of the first ribs may be provided on the outer circumferential surface of the support 111. The first rib 120 may be integrally injection-molded with the support 111. Accordingly, the one ends 121 of the first ribs 120 may extend in the direction B perpendicular to the rotational axis A from the outer circumferential surface of the support 111, and may protrude from the rear portion 110 in the direction C corresponding to the rotational axis A.

The first ribs 120 may extend in an approximately straight line, and the other ends 122 of the first ribs 120 may be provided adjacent to the outer circumferential surface of the rear portion 110.

However, the present embodiment of the present disclosure is not limited thereto, and the first ribs 120 may be provided in a shape including a curved shape. When the first ribs 120 are provided in a curved shape, a direction of curvature of the plurality of first ribs 120 may be preferably directed in one direction.

As described above, the stress generated from the driving shaft 90 is transferred to the rear portion 110 via the bearing housing 70. Particularly, the stress may be mostly transferred to a portion of the rear portion 110 adjacent to the bearing housing 70.

Accordingly, since the one ends 121 of the first ribs 120 and one sides of the first ribs 120 adjacent to one ends 121 receive the highest stress, the first ribs 120 need to be designed to have rigidity against stress.

In order to maintain high rigidity at portions adjacent to the one ends 121 of the first ribs 120, a thickness of the one end 121 of the first rib 120 may be greater than a thickness of the other end 122 of the first rib 120.

Here, the thickness of the first rib 120 may be defined as a width having a length crossing an extending direction of the first ribs 120 corresponding to a rotational direction around the rotational axis A.

That is, the one side (hereinafter, a first portion 125) adjacent to the one end 121 of the first rib 120 may be molded to have a greater thickness than the other side (hereinafter, a second portion 126) adjacent to the other end 122 of the first rib 120. A portion of the first rib 120 on the first portion 125 side is designed to have a higher weight ratio to secure higher rigidity.

As described above, since high stress is generated at a portion adjacent to support 111, higher stress is generated at the first portion 125 than at the second portion 126.

Accordingly, when the first ribs 120 are injection-molded, it is possible to secure higher rigidity with respect to the same weight when the weight of the first rib 120 is further disposed at the side adjacent to the support 111 compared to when the one end 121 and the other end 122 of the first rib 120 have the same thickness.

In detail, in the case of a first rib having the same weight as the weight of the first rib 120 according to one embodiment of the present disclosure, when the one end 121 and the other end 122 have the same thickness or the first portion 125 and the second portion 126 have the same thickness is injection-molded, the thickness of the first portion 125 decreases as much as the thickness of second portion 126 increases.

Accordingly, the mass or volume of the first portion 125 decreases, and an amount of rigidity reduced by the decreased mass or volume may not be secured.

Accordingly, in this case, in order to secure the rigidity of the first portion 125 adjacent to the first rib 120 according to one embodiment of the present disclosure, an overall thickness of the first rib 120 has to be increased, and accordingly, since the weight of a plastic resin and the like necessary for producing the first rib 120 increases, production costs and an overall weight of the washing machine 1 can increase.

As described in one embodiment the present disclosure, since the case in which the first portion 125 is designed to have a greater thickness than the second portion 126 secures higher rigidity than the case in which the first portion 125 and the second portion 126 have the same thickness, a washing machine can be lightened and production costs can be reduced.

Further, as the rigidity of the rear portion 110 increases, a capacity of the drum 30 can be further increased, a high capacity washing machine can be embodied, and since vibrations and noise during high speed operation can be reduced, the operation reliability of the washing machine 1 can be secured.

As described above, since the one end 121 of the first rib 120 is formed to have a greater thickness than the other end 122 of the first rib 120, the first rib 120 may be provided in a tapered shape in which a thickness decreases in the radial direction B of the tub 100.

When it is assumed that the one end 121 of the first rib 120 refers to a bottom side, and the other end 122 of the first rib 120 refers to a top side, the first rib 120 may be provided in a trapezoidal pillar shape configured to protrude in the rearward direction C of the rotational axis A. Accordingly, a pair of extension lines extending from both ends of the bottom side (the one end 121 of the first rib 120) to both ends of the topside (the other end 122 of the first rib 120) may be disposed in a diagonal direction in which the thickness of the first rib 120 gradually decreases toward the outer circumferential surface of the rear portion 110.

The present embodiment of the present disclosure is not limited thereto, and the first rib 120 may be provided in a shape other than the tapered shape. A step may be provided between the first portion 125 and second portion 126 in the direction C corresponding to the rotational axis A, thus the first portion 125 and second portion 126 may be provided to have different thicknesses, or the first rib 120 may be provided in a shape including a curved shape.

A rounding portion 112 may be provided at a portion at which the support 111 is in contact with the first rib 120. That is, a portion at which the outer circumferential surface of the support 111 is in contact with the one end 121 of the first rib 120 or a portion at which the first rib 120 starts to extend from the outer circumferential surface of the support 111 may be processed to be rounded and injection-molded.

The rounding portion 112 may be provided to cover the portion at which the support 111 is in contact with the first rib 120 to improve the rigidity of the portion.

The rear portion 110 may include a second rib 130 formed in an annular shape and protruding in the rearward direction C of the rotational axis A. The second rib 130 may be formed in a cylindrical shape around the rotational axis A.

The second rib 130 may be integrally injection-molded with the rear portion 110, or may be integrally injection-molded with the rear portion 110 and the first ribs 120.

The second rib 130 may be provided on one side between the support 111 and an outer circumferential surface the rear portion 110. Further, the second rib 130 may be provided to cross the plurality of first ribs 120 in the rotational direction around the rotational axis A to support the first ribs 120.

Since the second rib 130 is provided so as to cross the first ribs 120, the second rib 130 may support both sides of the first ribs 120 on the basis of longitudinal directions of the first ribs 120. Accordingly, the rigidity of the first rib 120 may be further secured.

The second rib 130 may have a thickness defined in the radial direction B of the tub 100 perpendicular to the rotational axis A, and the second rib 130 may have a smaller thickness than the first rib 120 because the amount of stress formed at the second rib 130 is less than the amount of the stress formed at the first rib 120.

The second rib 130 may be provided as a plurality. Preferably, the second rib 130 may be provided as a plurality of annular ribs having various diameters on the basis of the rotational axis A. The plurality of second ribs 130 may be disposed to be spaced apart from each other in the radial direction B and the number thereof is not limited.

Further, all the plurality of second ribs 130 may have the same thickness, and in some cases, may be provided as a plurality of ribs having various thicknesses.

The second rib 130 may be provided to protrude in the same direction as the outward direction C of the rear portion 110, in which the first rib 120 protrudes. Although a protruding height of the second rib 130 is preferable to be identical to a protruding height of the first rib 120, when injection molding is performed, the protruding height of the second rib 130 may be changed according to a shape of a mold of an injection-molding machine.

The rear portion 110 may further include auxiliary ribs 140 provided between the plurality of first ribs 120. The auxiliary ribs 140 may be disposed between the plurality of adjacent first ribs 120, and may be provided to protrude in the rearward direction C of the rotational axis A.

The auxiliary rib 140 may extend in the radial direction B of the tub 100 from the rotational axis A, and may be integrally injection-molded with the rear portion 110 like the first rib 120 and the second rib 130.

One end 141 of the auxiliary rib 140 may be provided on a second rib **130*a* closest to the support 111, and the other end 142 of the auxiliary rib 140 may be adjacent to the outer circumferential surface of the rear portion 110. Accordingly, the auxiliary rib 140 may extend from an outer circumferential surface of the second rib 130*a* adjacent to the support 111 to the outer circumferential surface of the rear portion 110** and may be provided in a radial form.

The one end 141 of the auxiliary rib 140 may have a greater thickness than the other end 142 of the auxiliary rib 140 like the one end and the other end of the first rib 120 because the one end 141 of the auxiliary rib 140 is closer to the bearing housing 70 and more stress is formed at the one end 141 of the auxiliary rib 140.

Unlike the present embodiment of the present disclosure, the one end 141 of the auxiliary rib 140 may be provided on the support 111 rather than the second rib **130*a* adjacent to the support 111. The one end 141 of the auxiliary rib 140** may be provided at various locations according to a shape of a mold during injection molding.

An overall thickness of the auxiliary rib 140 may be preferably provided to be smaller than the thickness of the first rib 120 because the amount of stress formed at the auxiliary rib 140 is less than the amount of stress formed at the first rib 120.

Hereinafter, a coupling configuration of the tub 100 and the driving motor 40 will be described in detail.

Figure 9:
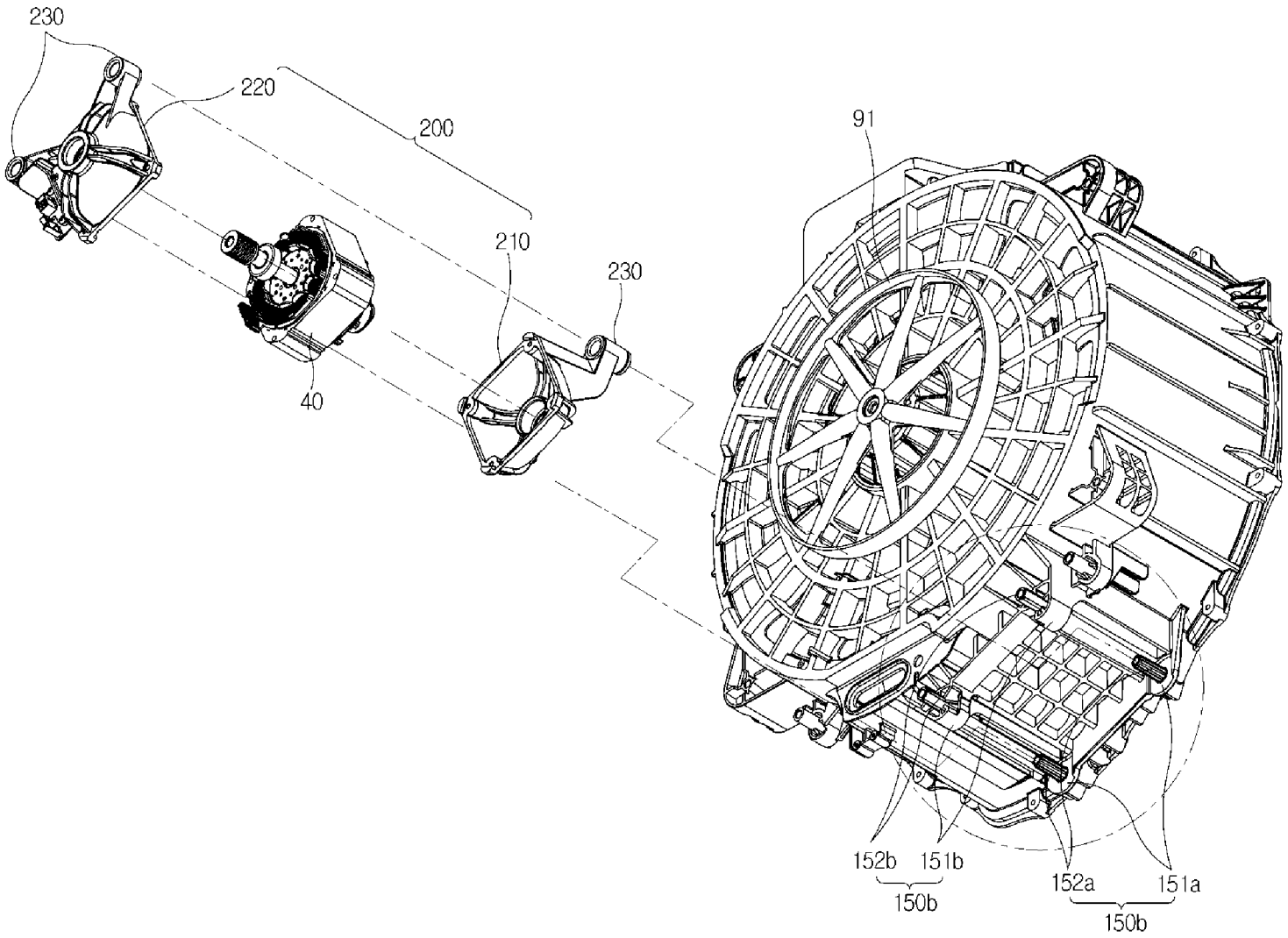
FIG. 9 is an exploded perspective view of a partial configuration of the washing machine according to one embodiment of the present disclosure.
Figure 10:
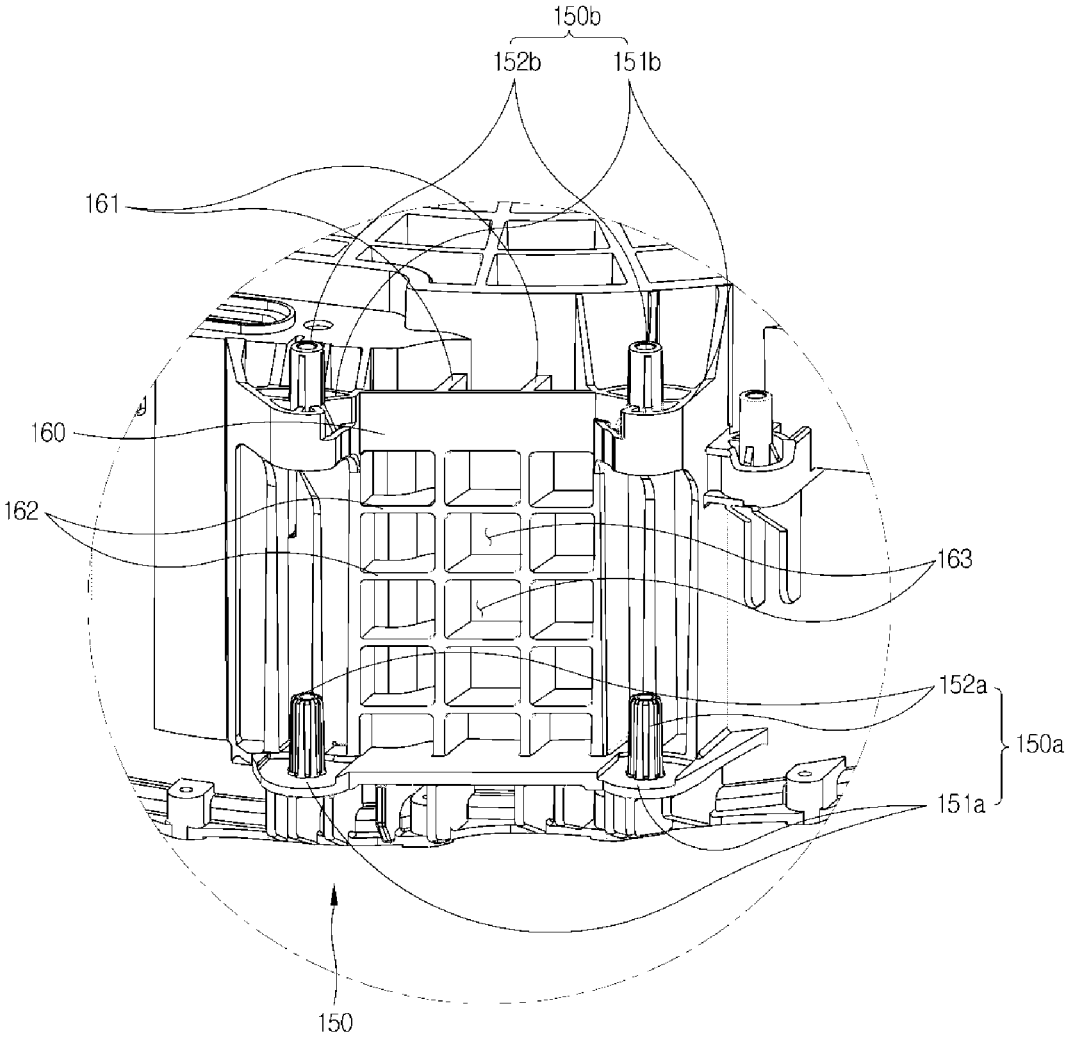
FIG. 10 is an enlarged perspective view of another side surface of the rear tub of the washing machine according to one embodiment of the present disclosure.
Figure 11:
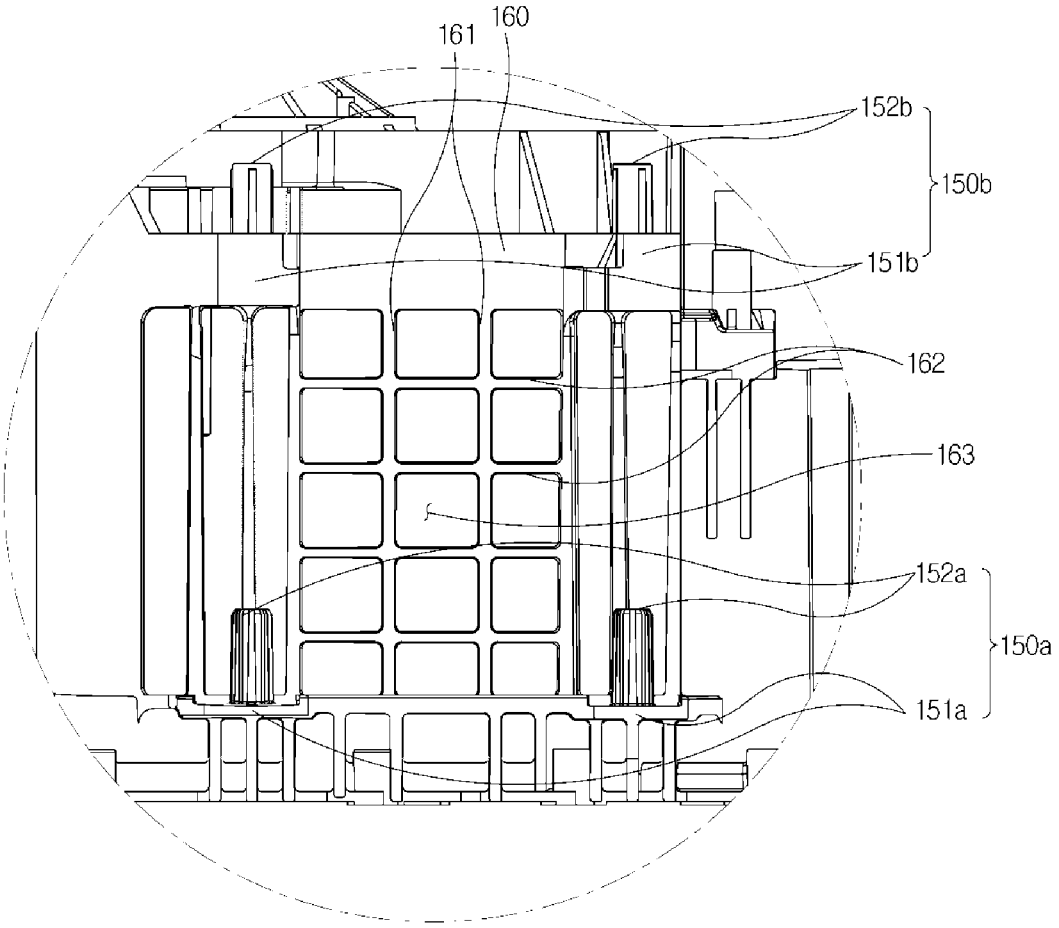
FIG. 11 is an enlarged side view of the rear tub of the washing machine according to one embodiment of the present disclosure.

FIG. 9 is an exploded perspective view of a partial configuration of the washing machine according to one embodiment of the present disclosure, FIG. 10 is an enlarged perspective view of another side surface of the rear tub of the washing machine according to one embodiment of the present disclosure, and FIG. 11 is an enlarged side view of the rear tub of the washing machine according to one embodiment of the present disclosure.

A coupler 150 to which the driving motor 40 is coupled may be provided at a lower side of the rear tub 102. The coupler 150 may include a pair of coupling flanges 151 (151*a* and 151*b*) extending from an outer circumferential surface of the rear tub 102 in the direction B perpendicular to the rotational axis A, and a pair of coupling protrusions 152 configured to protrude from the pair of coupling flanges 151 in one direction.

The coupler 150 may be provided as a plurality for stably coupling of the driving motor 40 at both a front side and a rear side of the driving motor 40. First couplers 150*a* may be provided at a side corresponding to the front side of the driving motor 40, and second couplers 150*b* may be provided at a side corresponding to the rear side of the driving motor 40.

A motor bracket 200 configured to cover the driving motor 40 may be provided at an outer side of the driving motor 40. The motor bracket 200 may be provided in a shape configured to cover at least one side of the driving motor 40 to support the driving motor 40.

In detail, the motor bracket 200 may be separated into a front bracket 210 configured to cover the front side of the driving motor 40 and a rear bracket 220 configured to cover a rear side of the driving motor 40. (The front side and rear side of the driving motor 40 are based on a front side and a rear side of the washing machine 1.)

However, the present embodiment of the present disclosure is not limited thereto, and the front bracket 210 and the rear bracket 220 may be integrally formed in a shape configured to cover an entire area of the driving motor 40 rather than one side of the driving motor 40.

The motor bracket 200 may be provided to have a pair of coupling grooves 230 provided in sides thereof adjacent to the motor bracket 200 and the rear tub 102. A pair of coupling protrusions 152 provided at the rear tub 102 may be inserted into the pair of coupling grooves 230.

Since the pair of coupling protrusions 152 are inserted into the pair of coupling grooves 230, the motor bracket 200 is coupled to the tub 100 and the driving motor 40 may be disposed to be supported at one side of the tub 100.

In detail, front coupling grooves 230*a* provided in the front bracket 210 may be coupled to first coupling protrusions 152*a* of the first couplers 150*a* provided at the rear tub 102, and rear coupling grooves 230*b* provided in the rear bracket 220 may be coupled to second coupling protrusions 152*b* of the second couplers 150*b* provided at the rear tub 102.

Since a rotational force is generated by the driving motor 40, the driving motor 40 vibrates, and the vibration of the driving motor 40 may be transferred to the rear tub 102 via the motor bracket 200.

Since stress separately generated by the vibration of the driving motor 40 is added to stress generated in the rear tub 102, particularly, the rear portion 110, the durability of the tub 100 may become a problem.

In order to prevent this problem, the coupler 150 may include a buffer rib 160 to secure rigidity with respect to the stress generated from the driving motor 40.

The buffer rib 160 may be provided between an outer surface of the rear tub 102 and the coupler 150. Since the stress generated from the driving motor 40 is transferred to the coupler 150 via the motor bracket 200, the buffer rib 160 is disposed between the coupler 150 and the rear tub 102 so that a buffering effect occurs before the stress is transferred to the rear tub 102.

Since the buffer rib 160 acts to buffer the stress, the rear tub 102 adjacent to the coupler 150 may have relatively improved rigidity.

In detail, the buffer rib 160 may be provided between the outer surface of the rear tub 102 and the coupling protrusion 152 to which the stress is transferred first before arriving at the rear tub 102.

The buffer rib 160 may be provided to extend from one flange of the pair of coupling flanges 151 to the other flange of the pair of coupling flanges 151. Further, the buffer rib 160 provided between the pair of coupling flanges 151 may extend in an axial direction of the tub 100 and may be provided in a plate shape.

The buffer rib 160 may be provided to extend from a side adjacent to the second coupler 150*b* to the first coupler 150*a*. However, the present embodiment of the present disclosure is not limited thereto, and the buffer rib 160 may extend to one side between the second coupler 150*b* and the first coupler 150*a*.

A first auxiliary buffer rib 161 and a second auxiliary buffer rib 162 configured to support the buffer rib 160 may be provided between the buffer rib 160 and the outer surface of the rear tub 102.

The first and second auxiliary buffer ribs 161 and 162 may support the buffer rib 160 to improve the rigidity of the buffer rib 160.

The first and second auxiliary buffer ribs 161 and 162 may protrude outward from the outer circumferential surface of the rear tub 102, and may be in perpendicular contact with the buffer rib 160.

A side of the first auxiliary buffer rib 161 corresponding to the axial direction of the tub 100 may be provided to extend in a longitudinal direction. A plurality of first auxiliary buffer ribs 161 may be provided and may be disposed to be spaced apart from each other.

The second auxiliary buffer rib 162 may be provided to cross the first auxiliary buffer rib 161. Preferably, the second auxiliary buffer rib 162 may be provided to be perpendicular to the first auxiliary buffer rib 161. A plurality of second auxiliary buffer ribs 162 may be provided and may be disposed to be spaced apart from each other.

Open portions 163 may be provided in a side of the buffer rib 160 with which the first and second auxiliary buffer ribs 161 and 162 are not in contact in order to reduce the weight of the buffer rib 160, thereby lightening the tub 100 and saving production costs.

However, unlike the present embodiment of the present disclosure, the buffer rib 160 may not include the open portions 163, and the open portions 163 may not be provided in a lattice form like the present embodiment of the present disclosure.

Hereinafter, first ribs 120*a* according to another embodiment of the present disclosure will be described. Since components, except for this component, of the below-described washing machine 1 are the same as the components of the above-described washing machine 1 according to one embodiment, repetitive descriptions thereof will be omitted.

Figure 12:
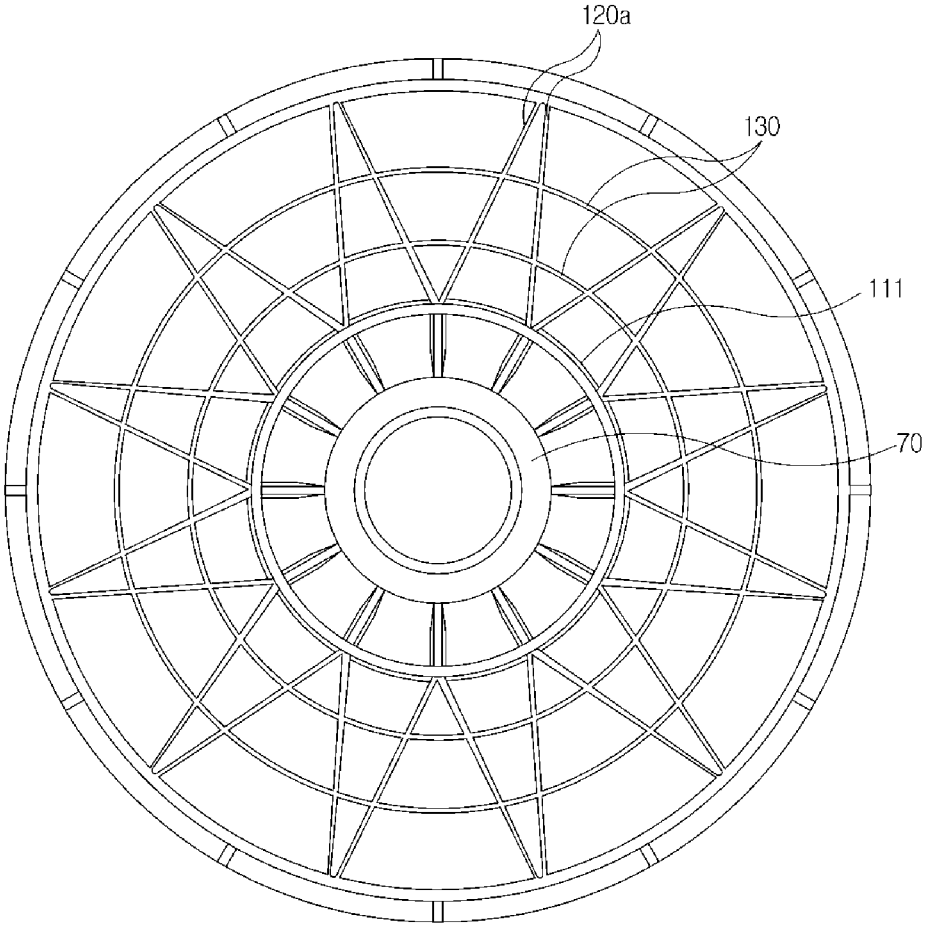
FIG. 12 is a rear view of a rear tub of a washing machine according to another embodiment of the present disclosure.

FIG. 12 is a rear view of a rear tub of a washing machine according to another embodiment of the present disclosure.

The first ribs 120*a* may be provided to extend from a support 111 to an outer side of a rear portion 110.

Each of the plurality of first ribs 120*a* according to another embodiment of the present disclosure may be formed as two ribs 120*a*' and 120*a*" unlike the plurality of first ribs 120 according to the above-described one embodiment.

In detail, each of the first ribs 120*a* may be provided as the two ribs 120*a*' and 120*a*" symmetrically disposed with respect to the direction B perpendicular to the rotational axis A.

One ends of the two ribs 120*a*' and 120*a*" adjacent to the rotational axis A are spaced apart from each other and provided on the support 111, and the two ribs 120*a*' and 120*a*" are diagonally disposed to face each other, the other ends of the two ribs 120*a*' and 120*a*" adjacent to an outer circumferential surface of a tub 100 may be provided closer to each other than the one ends.

In some cases, the other ends of the two ribs 120*a*' and 120*a*" may be in contact with each other at a side adjacent to the outer circumferential surface of the tub 100.

The plurality of first ribs 120*a* each configured as the pair of ribs may be disposed in a radial form along an outer circumferential surface of the support 111.

In detail, symmetrical axes of the two ribs 120*a*' and 120*a*" corresponding to the radial direction B of the tub 100 may be formed in a radial form, and accordingly, the two ribs 120*a*' and 120*a*" may symmetrically extend from the support 111 in a diagonal direction with respect to the radial direction B of the tub 100.

Further, the one ends of the two ribs 120*a*' and 120*a*" may extend in the diagonal directions in a state of being in contact with one ends of two ribs 120*a*' and 120*a*" of another first rib 120*a* adjacent thereto. Accordingly, all the first rib 120*a* may be disposed in a zigzag form between the support 111 and the outer side of the rear portion 110.

Accordingly, since the plurality of first ribs 120*a* are disposed between the support 111 and the outer side of the rear portion 110 along circumferences of the support 111 and the outer side of the rear portion 110, the rigidity of the rear portion 110 may be maintained.

Hereinafter, a plurality of auxiliary ribs 140*b* according to still another embodiment of the present disclosure will be described. Since components, except for this component, of the below-described washing machine 1 are the same as the components of the above-described washing machine 1 according to one embodiment, repetitive descriptions thereof will be omitted.

Figure 13:
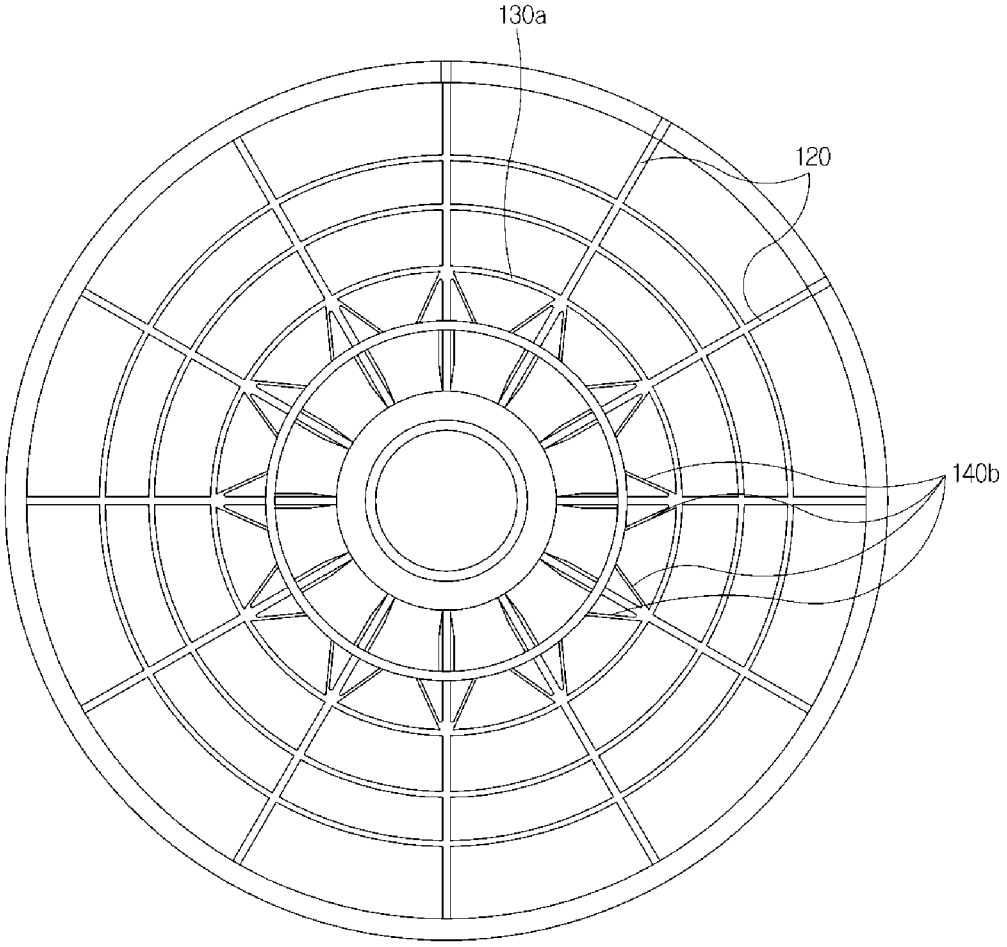
FIG. 13 is a rear view of a rear tub of a washing machine according to still another embodiment of the present disclosure.

FIG. 13 is a rear view of a rear tub of a washing machine according to still another embodiment of the present disclosure.

The plurality of auxiliary ribs 140*b* according to still another embodiment of the present disclosure may be disposed in a different form from the radial form like the plurality of auxiliary ribs 140*b* according to the above-described one embodiment. In one embodiment, the auxiliary ribs 140*b* may be disposed in a diagonal direction with respect to first ribs 120 disposed in a radial form.

In detail, pairs of auxiliary ribs 140*b* may be symmetrically disposed with respect to the plurality of first ribs 120. One ends of two auxiliary ribs 140 as a pair are disposed on a support 111 to be spaced apart from each other.

Each of the auxiliary ribs 140 may be diagonally disposed so as to be close to each other, and the other ends of the two auxiliary ribs 140*b* may be in contact with an inner circumferential surface of a second rib 130*a* adjacent to the support 111.

The pairs of auxiliary ribs 140*b* may be disposed along an outer circumferential surface of the support 111, and may be disposed in a triangular form, of which a bottom side is the support 111, between the support 111 and the inner circumferential surface of the second rib 130*a* adjacent to the support 111

As described above, since most of stress generated at the rear portion 110 is generated from a side adjacent to the support 111, the auxiliary ribs 140*b* may be disposed on the support 111 in a concentrated manner to secure high rigidity.

The present embodiment of the present disclosure is not limited thereto, and the auxiliary ribs 140*b* may be disposed in a radial form between the support 111 and the second rib 130*a* adjacent to the support 111, and may also be disposed in other forms.

Further, the other ends of the auxiliary ribs 140*b* may be provided on another second rib 130 other than the second rib 130*a* adjacent to the support 111.

Hereinafter, first ribs 120*c* and auxiliary ribs 140*c* according to yet another embodiment of the present disclosure will be described. Since components, except for these components, of the below-described washing machine 1 are to the same as the components of the above-described washing machine 1 according to one embodiment, repetitive descriptions thereof will be omitted.

Figure 14:
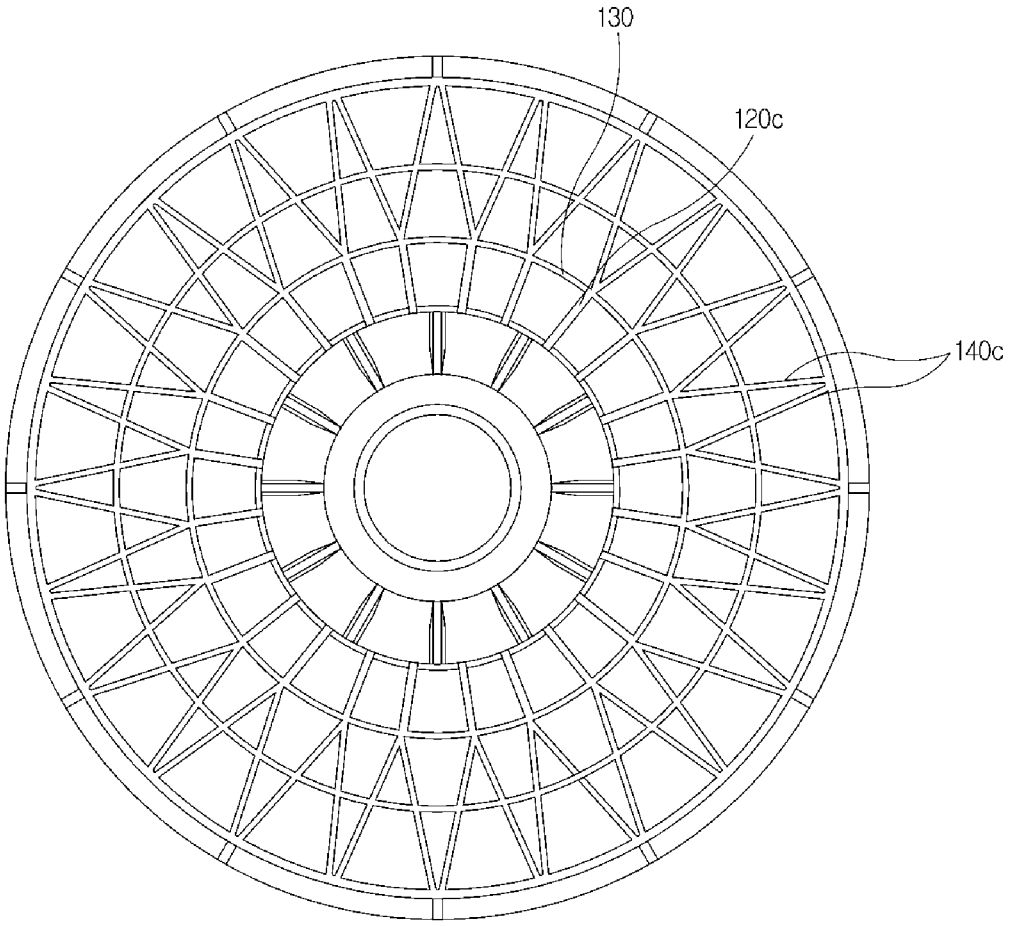
FIG. 14 is a rear view of a rear tub of a washing machine according to yet another embodiment of the present disclosure.

FIG. 14 is a rear view of a rear tub of a washing machine according to yet another embodiment of the present disclosure.

A plurality of first ribs 120*c* are provided along an outer circumferential surface of a support 111 and may be disposed in a radial form. The plurality of first ribs 120*c* may be provided to extend from the support 111 to a second rib 130*a* adjacent to the support 111.

That is, one ends of the plurality of first ribs 120*c* may be disposed along the outer circumferential surface of the support 111, and the other ends of the plurality of first ribs 120*c* may be disposed along an inner circumferential surface of the second rib 130*a* adjacent to the support 111.

The auxiliary ribs 140*c* may be disposed in diagonal directions along an outer circumferential surface of the second rib 130*a* adjacent to the support 111.

In detail, pairs of auxiliary ribs 140*c* may be symmetrically disposed with respect to the radial direction B of a tub 100 extending from a rotational axis A of a rear portion 110. One ends of the two auxiliary ribs 140*c* as a pair are disposed to be spaced apart from each other on the outer circumferential surface of the second rib 130*a* adjacent to the support 111.

Each of the auxiliary ribs 140*c* may be diagonally disposed in a direction in which the auxiliary ribs 140*c* are close to each other and the other ends of the two auxiliary ribs 140*c* may be in contact with a side adjacent to an outer circumferential surface of the tub 100.

The pairs of two auxiliary ribs 140*c* may be disposed along the outer circumferential surface of the second rib 130*a* adjacent to the support 111, and all the pairs of two auxiliary ribs 140*c* may be disposed in a zigzag form between the second rib 130*a* adjacent to the support 111 and an outer portion of the rear portion 110.

In a different manner, one end of one auxiliary rib 140*c* among the plurality of auxiliary ribs 140*c* provided along the outer circumferential surface of the second rib 130*a* adjacent to the support 111 may be provided in contact with one end of another auxiliary rib 140*c* adjacent to the one end of the one auxiliary rib 140*c*.

Preferably, a side with which one ends of the auxiliary ribs 140*c* are in contact may be provided adjacent to the inner circumferential surface of the second rib 130*a* at which the other ends of the first ribs 120*c* are adjacent to the support 111.

Thus, the one ends of the auxiliary ribs 140*c* support the other ends of the first ribs 120*c* to secure higher rigidity.

Hereinafter, a buffer rib 160 according to yet another embodiment of the present disclosure will be described. Since components, except this component, of the below-described washing machine 1 are to the same as the components of the above-described washing machine 1 according to one embodiment, repetitive descriptions thereof will be omitted.

Figure 15:
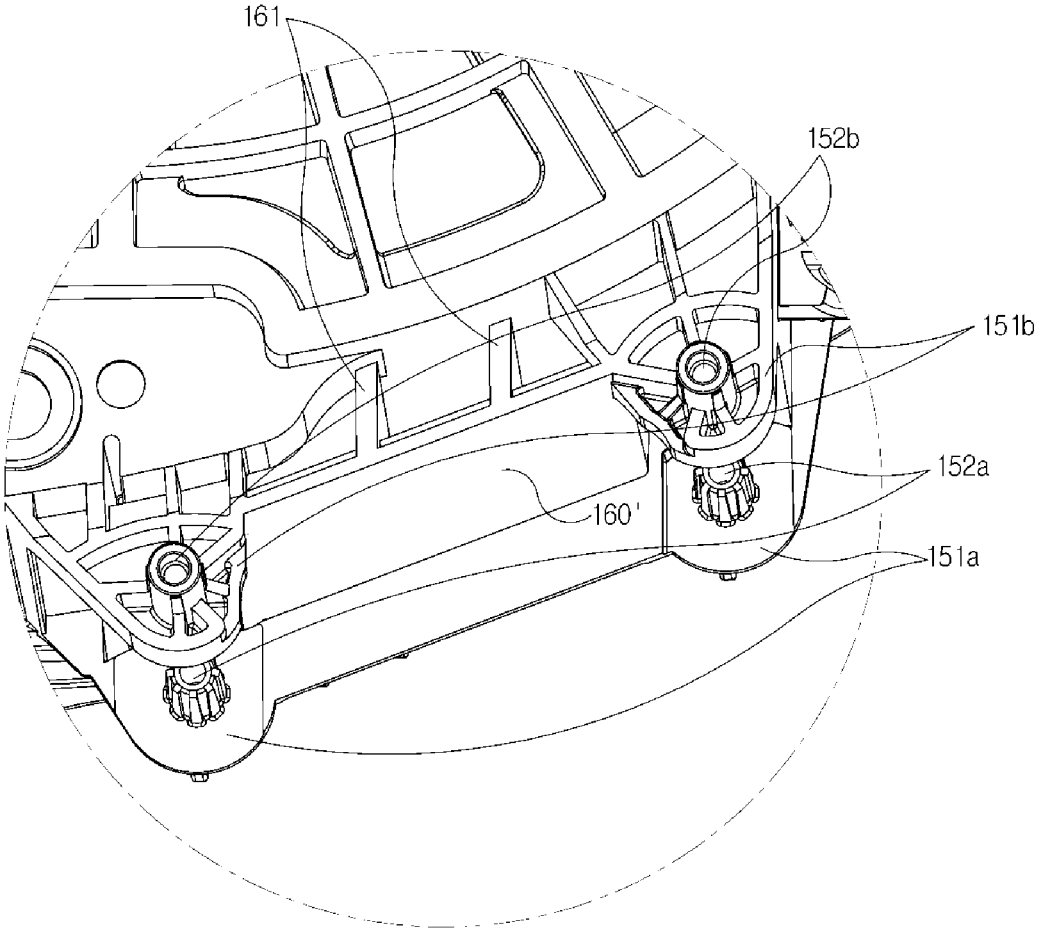
FIG. 15 is an enlarged perspective view of a rear tub of a washing machine according to yet another embodiment of the present disclosure.
Figure 16:
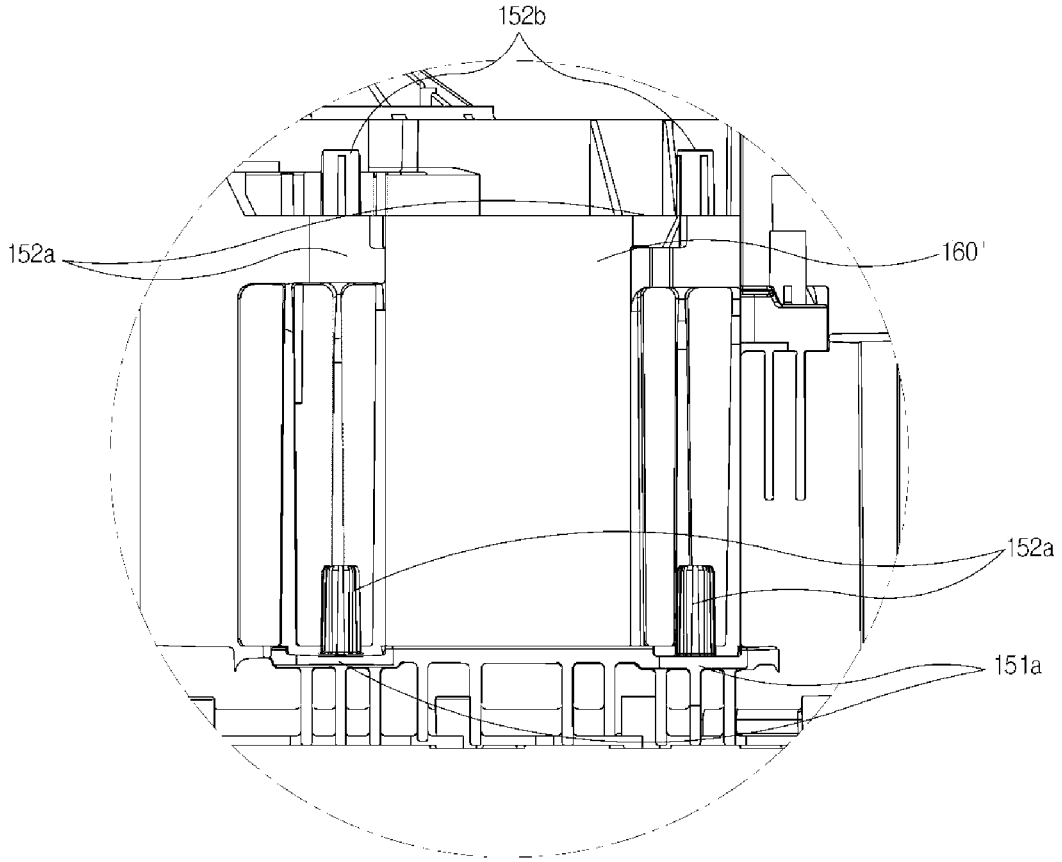
FIG. 16 is an enlarged side view of the rear tub of the washing machine according to yet another embodiment of the present disclosure.

FIG. 15 is a perspective view of a rear tub of a washing machine according to yet another embodiment of the present disclosure, and FIG. 16 is a side view of the rear tub of the washing machine according to yet another embodiment of the present disclosure.

A buffer rib 160' may be provided to extend from one flange of a pair of coupling flanges 151 to the other flange of the pair of coupling flanges 151. Further, the buffer rib 160' provided between the pair of coupling flanges 151 may extend in an axial direction of a tub 100 and may be provided in a plate shape.

The buffer rib 160' may be provided to extend from a side adjacent to a second coupler 150*b* to a first coupler 150*a*. The buffer rib 160' may not include an open portion 163 unlike the above-described buffer rib 160 according one embodiment of the present disclosure.

A first auxiliary buffer rib 161 configured to support the buffer rib 160' may be provided between the buffer rib 160' and an outer surface of a rear tub 102. A side of the first auxiliary buffer rib 161 corresponding to the axial direction of the tub 100 may be provided to extend in a longitudinal direction. A plurality of first auxiliary buffer ribs 161 may be provided and disposed to be spaced apart from each other.

The buffer rib 160' may not include the second auxiliary buffer ribs 162 unlike the above-described buffer rib 160 according one embodiment of the present disclosure because the buffer rib 160' is provided in the plate shape including the open portion 163 to maintain sufficient rigidity.

Although a few embodiments of the present disclosure have been shown and described, it should be appreciated by those skilled in the art that changes may be made to the embodiments without departing from the principles and spirit of the present disclosure, and the scope of the present disclosure is defined in the claims and their equivalents.

Although the present disclosure has been described with various embodiments, various changes and modifications may be suggested to one skilled in the art. It is intended that the present disclosure encompass such changes and modifications as fall within the scope of the appended claims.

The invention claimed is:

1. A washing machine comprising:

a tub;

a drum located inside the tub and installed to be rotatable; and a bearing housing which is a separate component from the tub and through which a driving shaft configured to drive the drum passes, wherein the bearing housing is insertably coupled with the tub, the bearing housing including a plurality of bearing ribs extending from an inner circumferential surface of the bearing housing adjacent to the driving shaft to an outer circumferential surface of the bearing housing;

a driving motor configured to rotate the drum;

a plurality of coupling flanges provided on one side of the tub to which the driving motor is coupled;

a buffer rib disposed between an outer circumferential surface of the tub and the plurality of coupling flanges, the buffer rib extending from one of the plurality of coupling flanges to another of the plurality of coupling flanges; and first and second auxiliary buffer ribs configured to support the buffer rib, wherein:

the tub includes one end provided at one side of a rotational axis of the drum and having an opening and another end provided at another side of the rotation axis of the drum and having the bearing housing disposed on the rotational axis, the other end of the tub includes a plurality of first ribs corresponding to the plurality of bearing ribs and extending in a direction crossing the rotational axis to support the bearing housing and a support provided in an annular shape such that an inner circumferential surface of the support contacts the outer circumferential surface of the bearing housing, each of the plurality of the first ribs has a thickness defined in a rotational direction of the rotational axis, the thickness of each of the plurality of first ribs at one side provided adjacent to the rotational axis being greater than the thickness of the other side thereof provided farther than the one side with respect to the rotational axis and adjacent to an outer circumferential surface of the tub, and the thickness of each of the plurality of the first ribs continually decreases along a length substantially from the one side to the other side.

2. The washing machine of claim 1, wherein, assuming the one side of each of the plurality of first ribs refers to a bottom side and the other side of the plurality of first ribs refers to a top side, a shape of each of the plurality of first ribs is provided in a trapezoidal pillar shape protruding toward the other end of the tub.

3. The washing machine of claim 1, wherein the plurality of first ribs are provided in a radial form formed in a radial direction of the tub from the rotational axis.

4. The washing machine of claim 1, wherein:

the support covers the outer circumferential surface of the bearing housing to support the bearing housing; and the plurality of first ribs are provided in a radial direction of the tub from an outer circumferential surface of the support.

5. The washing machine of claim 4, wherein a portion at which the support is in contact with the plurality of first ribs includes a rounding portion.

6. The washing machine of claim 1, further comprising a second rib located at the other end of the tub and provided in an annular shape.

7. The washing machine of claim 6, wherein:

the second rib has a thickness defined in a radial direction of the tub from the rotational axis; and the thickness of the second rib is smaller than the thickness of the one side of each of the plurality of first ribs.

8. The washing machine of claim 6, further comprising a plurality of third ribs provided in a radial form between the plurality of first ribs.

9. The washing machine of claim 8, wherein the plurality of third ribs extend from the second rib in a radial direction of the tub.

10. The washing machine of claim 1, wherein:

each of the plurality of first ribs includes two ribs provided to be symmetrical; and the two ribs provided to be symmetrical extend to face each other.

11. The washing machine of claim 6, wherein an auxiliary rib disposed in a diagonal direction with respect to the plurality of first ribs is provided between the outer circumferential surface of the bearing housing and the second rib.

12. The washing machine of claim 11, wherein the auxiliary rib is formed as a pair of auxiliary ribs and is provided in a shape symmetrical to at least one of the plurality of first ribs.

13. A washing machine comprising:

a tub;

a drum located inside the tub and installed to be rotatable; and a bearing housing which is a separate component from the tub and through which a driving shaft configured to drive the drum passes and insertably coupled with the tub, the bearing housing including a plurality of bearing ribs extending from an inner circumferential surface of the bearing housing adjacent to the driving shaft to an outer circumferential surface of the bearing housing;

a motor bracket in which a driving motor configured to rotate the drum is installed;

a motor coupler provided on one side of the tub to couple the motor bracket to the tub, the motor coupler comprising a plurality of coupling flanges;

a buffer rib disposed between an outer circumferential surface of the tub and the coupling flanges, the buffer rib extending from one of the plurality of coupling flanges to another of the plurality of coupling flanges; and first and second auxiliary buffer ribs configured to support the buffer rib, wherein:

the tub includes one end provided at one side of a rotational axis of the drum and having an opening and another end provided at another side of the rotation axis of the drum and having the bearing housing disposed on the rotational axis, the other end of the tub includes a plurality of first ribs corresponding to the plurality of bearing ribs and extending in a direction crossing the rotational axis to support the bearing housing and a support provided in an annular shape such that an inner circumferential surface of the support contacts the outer circumferential surface of the bearing housing, each of the plurality of the first ribs has a thickness defined in a rotational direction of the rotational axis, the thickness of each of the plurality of first ribs at one side provided adjacent to the rotational axis being greater than the thickness of the other side thereof provided farther than the one side with respect to the rotational axis and adjacent to the outer circumferential surface of the tub, and the thickness of each of the plurality of the first ribs continually decreases along a length substantially from the one side to the other side.

14. The washing machine of claim 13, wherein the buffer rib is spaced apart from the outer circumferential surface of the tub and extends in a direction corresponding to a rotational axis direction.

15. The washing machine of claim 13, wherein the buffer rib is provided so as to protrude from the outer circumferential surface of the tub in a direction crossing the rotational axis.

16. The washing machine of claim 13, further comprising a second rib located at the other end of the tub and provided in an annular shape.

17. The washing machine of claim 16, wherein:

the second rib has a thickness defined in a radial direction of the tub from the rotational axis; and the thickness of the second rib is smaller than the thickness of the one side of each of the plurality of first ribs.

18. The washing machine of claim 16, further comprising a plurality of third ribs provided in a radial form between the plurality of first ribs.

19. The washing machine of claim 18, wherein the plurality of third ribs extend from the second rib in a radial direction of the tub.

20. The washing machine of claim 16, wherein an auxiliary rib disposed in a diagonal direction with respect to the plurality of first ribs is provided between the outer circumferential surface of the bearing housing and the second rib.

* * * * *